US007879772B2

(12) United States Patent
Komiyama et al.

(10) Patent No.: US 7,879,772 B2
(45) Date of Patent: Feb. 1, 2011

(54) PROCESS FOR COLD PLASTIC WORKING OF METALLIC MATERIALS

(75) Inventors: Shinobu Komiyama, Tokyo (JP); Masayuki Yoshida, Tokyo (JP); Hidehiro Yamaguchi, Tokyo (JP)

(73) Assignee: Nihon Parkerizing Co., Ltd., Tokyo (JP)

( * ) Notice: Subject to any disclaimer, the term of this patent is extended or adjusted under 35 U.S.C. 154(b) by 123 days.

(21) Appl. No.: 12/382,215

(22) Filed: Mar. 11, 2009

(65) Prior Publication Data

US 2009/0178454 A1 Jul. 16, 2009

Related U.S. Application Data

(62) Division of application No. 10/508,999, filed as application No. PCT/JP03/03511 on Mar. 24, 2003, now abandoned.

(30) Foreign Application Priority Data

Mar. 25, 2002 (JP) ..... 2002-083906

(51) Int. Cl.
*C10M 137/06* (2006.01)
*C10M 129/40* (2006.01)
*C23C 22/12* (2006.01)

(52) U.S. Cl. ..... 508/108; 427/435

(58) Field of Classification Search ..... 508/108; 427/435

See application file for complete search history.

(56) References Cited

U.S. PATENT DOCUMENTS

| | | | | |
|---|---|---|---|---|
| 3,619,264 | A | 11/1971 | Worms et al. | |
| 4,192,793 | A | 3/1980 | Tanioka et al. | |
| 4,294,808 | A | 10/1981 | Wasel-Nielen et al. | |
| 4,461,680 | A | 7/1984 | Lashmore | |
| 4,761,188 | A | 8/1988 | Miyata | |
| 5,024,826 | A | 6/1991 | Linton | |
| 5,039,408 | A | 8/1991 | Ichitsuka et al. | |
| 5,211,833 | A | 5/1993 | Shirkhanzadeh | |
| 5,480,480 | A | 1/1996 | Lynch et al. | |
| 5,587,059 | A | 12/1996 | Yamoto et al. | |
| 6,001,784 | A | 12/1999 | Trivett | |
| 6,015,855 | A | 1/2000 | Dalton | |
| 6,150,308 | A * | 11/2000 | Deruyck et al. | 508/348 |
| 2001/0031693 | A1 | 10/2001 | Hoke et al. | |

FOREIGN PATENT DOCUMENTS

| | | | |
|---|---|---|---|
| GB | 1257172 | A | 12/1971 |
| GB | 2257712 | A | 1/1993 |
| JP | 51-44579 | A | 4/1976 |
| JP | 52-20967 | | 2/1977 |
| JP | 56-59896 | A | 5/1981 |
| JP | 58-15594 | A | 1/1983 |
| JP | 01110567 | A * | 4/1989 |
| JP | 6-346075 | A | 12/1994 |
| JP | 11100205 | A | 4/1999 |
| JP | 2000154010 | A * | 6/2000 |
| WO | 97/48783 | A1 | 12/1997 |
| WO | 99/64544 | A1 | 12/1999 |

OTHER PUBLICATIONS

Supp. European Search Report in EP 03 72 0889 mailed Feb. 3, 2010.

* cited by examiner

*Primary Examiner*—Glenn Caldarola
*Assistant Examiner*—Jim Goloboy
(74) *Attorney, Agent, or Firm*—Nixon & Vanderhye P.C.

(57) ABSTRACT

Particles each of which consists of an inorganic polyvalent metal compound as a nucleus and a coating of a metallic soap of the polyvalent metal coating the nucleus (coated particles); products and preparation processes using the particles; a lubricating coating forming agent wherein particles each of which consists of a polyvalent metal salt of phosphoric acid as a nucleus and a coating of a metallic soap of the polyvalent metal coating the surface of the nucleus are suspended in an aqueous solution of a water soluble inorganic salt and/or a water soluble organic acid salt; and a lubricating coating. The coated particles are novel particles which can be used as an ingredient of coating-type lubricating coating; are excellent in seizure resistance; can inhibit wear of tools at the time of plastic working since the friction coefficient of the surface of the particles is low; and are slow to cause pollution of working oils. Lubricating coating obtained by applying the lubricating coating forming agent onto the surface of a metallic material gives excellent cold plastic working properties, namely lubricity and seizure resistance to the metallic material.

19 Claims, No Drawings

PROCESS FOR COLD PLASTIC WORKING OF METALLIC MATERIALS

This application is a divisional of application Ser. No. 10/508,999 filed Sep. 27, 2004 now abandoned, which in turn is the US national phase of international application PCT/JP03/03511 filed 24 Mar. 2003, which designated the US and claims benefit of JP Application No. 2002-83906 filed 25 Mar. 2002, the entire contents of each of which are incorporated herein by reference.

TECHNICAL FIELD

This invention is roughly classified into two relevant inventions. One is an invention relating to particles of an inorganic polyvalent metal compound coated with a metallic soap as a fundamental invention, and their general utilization forms; and the other is an invention relating to a plastic working lubricant containing such coated particles as a more practical application form of such coated particles.

The invention as a fundamental invention can be used in a wide range, and relates to metallic soap-coated particles excellent in seizure resistance and capable of preventing tools from wear and working oil from pollution at the time of plastic working; powder or suspension on such particles; a process for preparing the powder or suspension; and lubricating coating.

The invention as a more practical applied invention relates to a lubricating coating forming agent, and, in more detail, relates to a lubricating coating forming agent giving excellent workability, namely excellent lubricity and excellent seizure resistance onto the surfaces of various metallic materials such as, for example, iron materials, steel materials, stainless steel materials, aluminum materials, magnesium materials, tin materials and titanium materials which need to be subjected to cold plastic working typically including forging, wire drawing, tube reducing and sheet forming; and lubricating coating.

BACKGROUND ART

Background Art Particularly About the Present Invention as a Fundamental Invention Metallic soap widely used as various lubricants, etc. plays an important role in the field of cold plastic working typically including forging, wire drawing, tube drawing of pipes, sheet forming, etc. of metallic materials. In this field, metallic soap has been used from long ago as a lubricating ingredient to lower the friction coefficient between materials to be wrought and tools at the time of plastic working and thereby reduce working energy drastically, and has greatly contributed to development of the cold plastic working field. For example, as a direct use example of metallic soap in the plastic working field, there can be mentioned its utilization in auxiliary lubricants used at wire drawing working. This is such a technology that when a carrier layer such as borax coating, slaked lime coating or zinc phosphate coating is provided on the surface of a wire rod and the rod is subjected to wire drawing working, immediately before the material to be wrought passes through the die, an auxiliary lubricant containing a large amount of a metallic soap is made to adhere onto the material to give or supplement lubricity; and is a case where powder of the metallic soap is used in a large amount. In another case, a coating-type lubricant in which lubricating particles containing a metallic soap as a main ingredient are suspended in water or an oil, etc. are used in many combinations with the above-mentioned carrier layer; and so on, and thus there are many technologies applying metallic soap in the cold plastic working field.

However, there are also problems in use of metallic soap. As one of them, there can be mentioned a case of steel wire for header working in which wire a carrier layer is provided by lime-type coating forming treatment, an auxiliary lubricant containing a metallic soap as a main ingredient is made to adhere thereon, and lubricating coating is completed by carrying out skin pass wire drawing working. The resulting lubricating coating-coated steel wire is subjected to header working in a working oil, but at that time, the metallic soap in the lubricating coating scraps peeling off swells or is finely suspended in the working oil to pollute the working oil extremely. This phenomenon is thought to occur because adhesion between the carrier layer and the lubricating coating layer is low.

On the other hand, as a lubricating coating forming technology, which is somewhat different from the above technology directly using metallic soap, but is very interesting in using metallic soap and very fit for cold plastic working, "phosphating treatment plus soap treatment" has generally been uses from long ago in this field. This technology is such that a phosphate salt coating layer is previously provided onto the surface of a material to be wrought, the coating layer firmly adhering to the surface as a reactive chemical conversion coating treatment layer, and then an aqueous solution of a water soluble fatty acid salt is contacted with the coating layer at an elevated temperature to form metallic soap coating containing a reactive soap layer. Since the phosphate salt coating surface is firmly coated with the metallic soap layer, this technology has such advantages in comparison with the above-mentioned "carrier layer plus auxiliary lubricant" that the technology is fit for comparatively strong working since working following properties of the lubricating ingredient are good, and such a phenomenon is hard to cause that the soap and the metallic soap are isolated from the lubricating coating scraps peeling off at the time of working and pollute the working oil extremely; and so on.

However, since both of the phosphating treatment and the coating treatment with the metallic soap onto the resulting layer are coating forming methods utilizing chemical reaction, control of the chemical reactions and administration activity at the cold plastic working site are complicated, and when waste water treatment and plant and equipment investment are included, vast costs are needed. Furthermore, since the performance of coating formed greatly varies depending on kinds of steels, surface states of steel, etc., labor for maintaining stable quality is very large, and, furthermore, mass formation of industrial wastes is coming to be a great anxiety on environmental load. Thus, in recent years, development of a convenient and ecological coating forming process has positively been attempted.

Lubricating coating comes in between the material to be wrought and the tool at the time of plastic working to avoid direct metal contact between the material to be wrought and the tool, and such lubricating coating may be liquid or solid. However practically, liquid lubricants represented by oil-type lubricants, etc. are often unfit for severe plastic working. The reason is that the lubricating coating preventing the material to be wrought and the tool from their direct contact undergoes shear to cause lubricating coating cutting, and thereby seizure occurs. Thus, even when a liquid lubricant is used or a lubricating ingredient such as metallic soap which melts and is liquidized with working heat is used, it is general to use it in combination with carrier coating such as phosphate salt coating or borax coating, and thereby, the lubricating ingredient together with the carrier layer comes in between the surface of the material to be wrought and the tool at the time of working, and reduces working force and prevents seizure. But strictly speaking, since, even in this situation, lubrication coating cutting occurs between the carrier layer surface and the tool surface, there sometimes arises a situation that the tool surface undergoes wear little by little by the carrier layer having a high friction coefficient and the life of the tool gets short, which gets to be a problem.

Furthermore, recently, there is a tendency that by shortening the step of cold plastic working for the purpose of heightening productive efficiency, the degree of one working is heightened, and, even in "phosphating treatment plus soap treatment", it gets difficult to follow surface area enlargement with sufficient lubricating layer held.

As a technology for forming cold plastic working lubricating coating for solving these problems, a step shortening-type lubricating coating forming agent, etc. are being developed. This technology is one capable of giving high cold plastic working performance by simple steps only to make a liquid coating forming agent adhere onto the surface of a material to be wrought and dry the agent. As such an invention, JP 2000-63880 A discloses a lubricant composition for plastic working of metallic material which comprises (A) a synthetic resin, (B) a water soluble inorganic salt and water, (B)/(A) (ratio by weight in terms of solid matter) being 0.25/1 to 9/1, the synthetic resin dissolving or being dispersed. It is also disclosed that it is preferred to further incorporate as a lubricant ingredient at least one selected from the group consisting of a metallic soap, a wax, polytetrafluoroethylene and an oil in an amount of 1 to 20% by mass, and as the water soluble inorganic salt is preferred at least one selected from the group consisting of a sulfate, a borate, molybdate, a vanadate and a tungstate. Namely, this invention is characterized in that a lubricating ingredient such as a metallic soap or a wax is contained, in a dispersed state, in coating ingredients capable of becoming a carrier, and is an excellent technology capable of obtaining lubricating coating having high working performance simply and with labor saving only by applying the composition onto the surface of the material to be wrought. Although metallic soap is often used as the lubricating ingredient, it is mentioned that, since the metallic soap is immobilized in the coating by the inorganic salt and/or the resin ingredient, adhesion of the metallic soap is not influenced by adhesion between layers, as is the case in "carrier layer plus auxiliary lubricant layer", the possibility of peeling of the metallic soap alone at the time of working is generally small. Furthermore, in comparison with the coating of "phosphate salt plus soap treatment" which is lubricating coating consisting of a comparatively large size of crystals of the order of width 200 μm, coating obtained from the above invention has an advantage that it is possible to adjust the surface area of the lubricant at will, e.g. by making lubricant ingredients fine particles, and thus lubricating coating exerting excellent performance even in strong working where enlargement of surface area is large is being developed, and the technology including the above invention is a prospective technology also in the aspect of lubricating performance. However, even in the case of the lubricating coating obtained by the above technology, there is a tendency that the carrier layer of a high friction coefficient exposed owing to the structure of the coating repeats contact with the tool to give the tool life bad influence.

Under such a present state of things, lubricating coating required in the cold plastic working field is considered to be lubricating coating which has such fine particle structure that the lubricant layer coats the carrier layer and strongly adheres to the carrier layer, and can be obtained by coating-type treatment without needing complicated treating steps. By this, it gets possible to realize ecological treatment of shortened steps, reduction of loads on the tool (i.e., reduction of tool wear), reduction of pollution of the working oil by lubricating coating scraps, etc. Development of such an ideal lubricant is a great problem and is urgently needed.

Background Art Particularly About the Present Invention as a More Practical Applied Invention In plastic working of metallic material, lubricating coating is formed on the surface of the material to be wrought, for preventing seizure and galling formed by direct metal contact between the material to be wrought and the tool. As lubricating coating formed on the surface of the material to be wrought, there are two types, one being lubricating coating formed by making a lubricant physically adhere to the surface of the material to be wrought, the other being lubricating coating formed by forming a chemical conversion coating on the surface of the material to be wrought through chemical reaction and then applying a lubricant.

Lubricants made to adhere onto the surface of the material to be wrought are inferior, in adhesion, to lubricants used after formation of a chemical conversion coating on the material to be wrought, and thus generally used in light working. In use of a chemical conversion coating, a chemical conversion coating such as a phosphate coating or an oxalate coating playing a role as a carrier is formed on the material to be wrought, and then a lubricant having good slipping properties is applied thereon. This type of coating has two layer structure consisting of the conversion coating as a carrier coating and the lubricant coating and exerts very high seizure resistance, and thus has very widely been used in the field of plastic working such as wire drawing, tube reducing and forging. Particularly in a field of severe working among the plastic working field, a method of using phosphate coating or oxalate coating as undercoat and applying a lubricant thereon is being frequently adopted.

Methods for forming a chemical conversion coating onto a material to be wrought and applying a lubricant thereon are classified broadly into two methods. One is a method of making a lubricant physically adhere onto the chemical conversion coating, and the other is a method of reacting a lubricant with the surface of the chemical conversion coating to form lubricating coating.

As the lubricant of the former made to physically adhere, there can be mentioned one obtained by adding an extreme pressure additive into mineral oil, vegetable oil or synthetic oil as a base oil; one obtained by dissolving or dispersing a solid lubricant represented by graphite or molybdenum disulfide together with a binder ingredient in water; etc. Such a lubricant is applied onto the surface of a material to be wrought which was subjected in advance to chemical conversion coating treatment, and, in the application, the oil lubricant is used as such, and the aqueous lubricant is used, followed by a drying step. These lubricants have advantages that there is no restriction about their application method and convenient spray coating or immersion coating can be used; and complicated liquid control as in chemical conversion coating treatment is almost unnecessary; etc., but these lubricants are often used in comparatively light working because of low lubricity.

On the other hand, as the lubricant of the latter to react it with the chemical conversion coating, there can generally be mentioned reactive soap. This method is a technology which has generally been used from long ago as "phosphating treatment plus soap treatment", and according to the method, a chemical conversion coating is formed on the surface of material to be wrought, and then an aqueous solution of a water soluble fatty acid salt is contacted with the coating at elevated temperature to form, on the coating, metallic soap coating containing the reactive soap. The composite coating formed according to this method can be adapted to from light working to comparatively strong working, and is used in a very wide range of working including forging and tube reducing.

However, as to reactive-type chemical conversion coating treatment and reactive soap treatment, there are two problems in a broad classification. One is that treatment steps for chemical conversion coating treatment and soap treatment are complicated; that very wide space is needed as the treatment space; and that control of treating steps is very complicated, for example that control of the concentration and ingredients of the treating liquid, and temperature control for controlling the reaction are needed because these treatments utilize chemical reactions. The other is that the amount of industrial wastes and waste water is very large, for example that since insoluble salts generally called sludge are formed in the treating liquid as by-products of the reactions, it is necessary to discharge them periodically from the treating liquid, and that since when the treating liquid is used successively, the ingredient balance of the treating liquid is spoiled, disposal and renewal of the treating liquid, etc. get necessary.

Detailed explanation is made bellow on the former. When "phosphate treatment plus soap treatment" is taken up as an example, a material to be wrought is first subjected to the cleaning step and the descaling step, and then to phosphating treatment and soap treatment. Since single or multi-stage water washing steps are necessary among these steps, space of about 7 to 12 vessels gets necessary as treating vessel space. Furthermore, control of the concentration and temperature of the treating liquid is necessary on each of the treating steps, and, in the phosphating step, free acid degree, total acid degree and accelerator concentration in the treating liquid are measured by manual operation according to a neutralization titration method and the like, and insufficient ingredients are supplemented appropriately. Furthermore, as to temperature, there are plural steps where the treatment is made at 60 to 80° C. and the heating is carried out with steam piping or the like, and thus a large amount of energy is used.

Detailed explanation is made bellow on the latter. When steel or iron material to be wrought is subjected to phosphating treatment, the surface of the material is etched in the phosphating solution and iron ions are eluted into the solution. Transfer of electrons occurs by this reaction and phosphate salt coating is formed, but for acceleration of the reaction, it is needed to deposit and precipitate the iron ions as an insoluble salt. This insoluble salt is generally called sludge. The sludge needs to be periodically discharged from the system. Furthermore, water washings after the pretreatments prior to chemical conversion coating treatment and after the chemical conversion coating treatment are contaminated with the treating liquids of the previous steps, respectively. Since the respective washings contain various elements, appropriate waste water treatments get necessary. Usually, these washings as waste water are discharged after subjection to neutralization treatment, coagulating sedimentation treatment, etc., but coagulating sedimentation sludge containing phosphorus, etc. is dumped as industrial wastes as is the case with the above-mentioned sludge.

In recent years, reduction of industrial wastes has been aimed as a large problem for the protection of earthly environment. Among such activities, chemical conversion coating treatment forming a lot of industrial wastes as mentioned above is taken up as one of large problems, and an alternative lubricant and/or an alternative treating system each forming less industrial wastes have/has strongly been desired.

For solving these problems, "a lubricating composition wherein a water soluble macromolecule or an aqueous emulsion thereof is used as a base material and a solid lubricant and a chemical conversion coating forming agent are compounded" etc., are disclosed in JP 52-20967 A, but coating equal to coating from chemical conversion coating treatment is not obtained. Also as a means for solving the above problems, there can, for example, be mentioned the invention of "an aqueous lubricant for cold plastic working of metallic material" disclosed in JP 10-8085 A and filed by the present applicant. The invention relates to an aqueous lubricant for cold forging working of metal which comprises (A) a water soluble inorganic salt, (B) a solid lubricant, (C) a at least one oil ingredient selected from mineral oil, vegetable or animal oil and synthetic oil, (D) a surfactant and (E) water, and wherein the solid lubricant and the oil are uniformly dispersed and emulsified.

The invention relates to an aqueous non-reactive-type lubricant, and, therein, it is aimed to shorten the three steps of phosphating treatment-water washing-reactive-type soap treatment to one step of lubrication treatment alone. Namely, the aqueous non-reactive-type lubricant is contacted with a cleaned material to be wrought by immersion or the like to coat the surface of the material with the lubricant, and then dried (evaporation of water) to form lubricating coating on the surface of the material. Such type of lubricant is called one-step lubricant. However, the lubricant of the above invention is too unstable to be used industrially because it emulsifies an oil ingredient, and has not exerted stable lubricity in cold forging of large working degree or in tube drawing working where continuous heat load is imposed on the lubricating coating.

As a further means for solving the above-mentioned problems, there can, for example, be mentioned the invention of "a lubricant composition for plastic working of metallic material" disclosed in JP 2000-63880 A and made by the present applicant. The invention relates to a lubricant composition for plastic working of metallic material which comprises (A) a synthetic resin, (B) a water soluble inorganic salt and water, and wherein the ratio by mass of (B)/(A) in terms of solid matter is 0.25/1 to 9/1 and the synthetic resin is dissolved or dispersed. However even in the invention, stable lubricity has not been exerted in cold forging of large working degree or in tube drawing working where continuous heat load is imposed on the lubricating coating. Furthermore in the invention, stable lubricity has not been exerted either in the cases where it is difficult, in actual operation, to apply a lubricant uniformly, for example in barrel treatment in cold forging, in bundled treatment in tube reducing working or in coil treatment in wire drawing working. Although it is indispensable to solve the above problems in use of a coating-type lubricant, it is a present state of things that an effective solution has not yet been found.

DISCLOSURE OF INVENTION

Problem 1

The present invention is for solving problems which prior art (particularly prior art on the present invention as a fundamental invention) has, and aims to provide novel particles, as an ingredient used mainly in coating-type lubricating coating, which are excellent in seizure resistance, and can inhibit wear of tools at the time of plastic working due to a low friction coefficient of their surfaces, and are slow to cause pollution of working oil; such particles that, when the particles are incorporated into a lubricant layer, the lubricant layer can make itself firmly composite with the carrier layer so that the former layer may coat the latter layer; powder consisting of the particles; a suspension containing the particles; processes for preparing the powder or suspension; and lubricating coating containing the particles.

Means for Solving Problem 1

The present inventors have intensely studied for solving the above problems (particularly Problem 1). As a result, they found that particles each of which consists of an inorganic polyvalent metal compound as a nucleus and a coating of a metallic soap of the polyvalent metal coating the nucleus, the inorganic polyvalent metal compound being water sparingly soluble or water insoluble and having reactivity with an alkali metal salt, ammonium salt or water soluble ester of a fatty acid; or particles each of which consists of each of the particles defined above and a coating of an alkali metal salt, ammonium salt or water soluble ester of a fatty acid coating the particle, when used mainly as an ingredient in coating-type lubricating coating, are very suitable as a material which is excellent in seizure resistance, can inhibit wear of tools at the time of plastic working due to a low friction coefficient of their surfaces, and is slow to cause pollution of working oil; and completed this invention.

Namely, the invention relates to particles each of which consists of an inorganic polyvalent metal compound as a nucleus and a coating of a metallic soap of the polyvalent metal coating the surface of the nucleus, the inorganic polyvalent metal compound being water sparingly soluble or water insoluble and having reactivity with an alkali metal salt, ammonium salt or water soluble ester of a fatty acid (hereinafter, the above particles are sometimes referred to as two-layer particles); particles each of which consists of each of the particles defined above and a coating of an alkali metal salt, ammonium salt or water soluble ester of a fatty acid (hereinafter, the "alkali metal salt, ammonium salt or water soluble ester of a fatty acid" is sometimes referred to as "alkali soap or the like") coating the surface of the particle (hereinafter, the above particles are sometimes referred to as three-layer particles); powder consisting of the particles; a suspension wherein the above particles are suspended in water or an aqueous solution of an alkali soap or the like, the average particle size of particles of the inorganic polyvalent metal compound being 20 μm or less, the proportion of all the metallic soap coatings to all the particles being 1 to 30% by mass; a process for preparing the above powder or suspension; lubricating coating containing the above particles in an amount of 1% by mass or more. Hereinafter, the two-layer particles and/or three-layer particles are sometimes referred to as coated particles.

Problem 2

The present invention is also for solving problems which prior art (particularly prior art on the present invention as a more practical applied invention) has. Namely, the invention aims to provide such a lubricating coating forming agent that protection of earthly environment is taken into consideration; convenient treatment by a spraying method or immersion method is possible; chemical conversion coating treatment is unnecessary; and resulting coating has excellent working performance and excellent seizure resistance equal to or more than those in chemical conversion coating treatment method, and, even when uniform application is difficult as mentioned above, exerts stable lubricating properties owing to self-repairing effect.

Means for Solving Problem 2

The present invention have intensely studied for solving the above problems (particularly Problem 2), and as a result, they found that lubricating coating wherein cold forging working of large working degree is possible and which exerts good lubricity even in tube drawing working in which continuous heat load is imposed on the coating, can be obtained by a convenient treating method of applying, onto a material to be wrought, an aqueous solution containing particles each of which consists of a polyvalent metal salt of phosphoric acid as a nucleus and a coating of a metallic soap of the polyvalent metal coating the surface of the nucleus, and a water soluble inorganic salt and/or a water soluble organic acid salt, and drying the resulting wet coating; and further found that the above-mentioned particles have both seizure resistance and lubricity, and, therefore, even in a case as mentioned above where uniform coating is difficult, the particles are introduced into the tool by melted ingredients in the coating and exert self-repairing effect on the defect parts of the coating, and, finally, the coating exerts stable lubricity; and completed the present invention.

Namely, the invention relates to a lubricating coating forming agent wherein particles each of which consists of a water sparingly soluble or water insoluble polyvalent metal salt of phosphoric acid (hereinafter merely referred to as polyvalent metal salt of phosphoric acid) as a nucleus and a coating of a metallic soap of the polyvalent metal coating the surface of the nucleus (the particles being hereinafter referred to as particles of coated polyvalent metal salt of phosphoric acid) are suspended in an aqueous solution of a water soluble inorganic salt and/or a water soluble organic acid salt; each of the water soluble inorganic salt and organic acid salt having a property to form a firm coating when it is uniformly dissolved in water and the resulting solution is applied on a metallic material and dried.

The above particles of coated polyvalent metal salt of phosphoric acid are included in the above-mentioned "two-layer particles" in the present invention as a fundamental invention.

BEST MODE FOR CARRYING OUT THE INVENTION

The invention is described in detail below, and, first, the invention as a fundamental invention is mainly described in detail, and, then, the invention as a practical applied invention is mainly described in detail.

Detailed Description Particularly on the Invention as a Fundamental Invention

The inorganic polyvalent metal compound which is used for preparing the coated particles of the invention, and is water sparingly soluble or water insoluble and has reactivity with an alkali soap or the like is an important ingredient as a nucleus immobilizing the metallic soap layer in the coated particles of the invention. The inorganic polyvalent metal compound used in the invention is a granular substance usually supplied as powder or in a state dispersed in water. The inorganic polyvalent metal compound is not particularly limited, and includes oxides, hydroxides, carbonates, phosphates, oxalates, etc. of polyvalent metals, and, as the polyvalent metal, Zn, Fe, Mn, Ni, Co, Ca, Mg, Ba, Al and Sn are preferred also in the aspect of the industrial cost, and Zn is further preferred among them. As preferred specific examples of the inorganic polyvalent metal compound, there can be mentioned zinc phosphate, zinc oxide, iron zinc phosphate, iron phosphate (ferrous phosphate, ferric phosphate), iron oxalate, manganese phosphate, nickel phosphate, cobalt phosphate, calcium phosphate, calcium hydrogenphosphate, calcium oxide, calcium hydroxide, etc., and among them zinc phosphate and zinc oxide are particularly preferably used.

The particle size of the inorganic polyvalent metal compound is preferably as small as possible for making the coated particles of lubricant use, and, specifically, is preferably 300 μm or less and more preferably 100 μm or less. As to the lower limit, there is no particular limitation, but from a limitation on preparation, the order of 0.3 μm is usually a limit. When it is intended to obtain the coated particles of the invention in a state suspended in water, the average particle size of the inorganic polyvalent metal compound is preferably 20 μm or less, and more preferably 10 μm or less. When the average particle size is more than 20 μm, it gets difficult to maintain stably the state dispersed in water.

The metallic soap coating the inorganic polyvalent metal compound in the invention is a salt between the polyvalent metal and the fatty acid composing the alkali soap or the like, the salt being formed by reaction of the inorganic polyvalent metal compound with the alkali soap or the like. As the metallic soap, there can be mentioned salts between a polyvalent metal such as Zn, Fe, Mn, Ni, Co, Ca, Al or Sn and a saturated fatty acid or unsaturated fatty acid having preferably 8 to 22, more preferably 16 to 20 carbon atoms (for example, palmitic acid, stearic acid, eicosanoic acid, oleic acid, etc.), and zinc stearate is mentioned representatively.

From the viewpoint of sufficiently coating the surfaces of the nuclei, the proportion of the metallic soap coatings to all the coated particles is preferably 1 to 30% by mass, and more preferably 2 to 15% by mass.

The coated particles of the invention also include particles each of which consists of a particle consisting of two layers of an inorganic polyvalent metal compound and a metallic soap of the polyvalent metal coating the metal compound, and a coating of an alkali soap or the like coating the particle. In the particles consisting of these three layers, the particles each of which consists of the inorganic polyvalent metal compound and the metallic soap of the polyvalent metal coating it may be the same as those mentioned above. In the three-layer particles, the proportion of the coatings of the alkali soap or the like to all the particles is preferably 0.1 to 5% by mass, more preferably 0.1 to 3% by mass in view of minimizing the amount of water soluble ingredients for the purpose of heightening the heat resistance of the particles and maintaining stable lubricating properties.

In the invention, the alkali soap or the like is not only needed for preparing the two-layer particles, but itself forms the outmost layer of the three-layer particles. The alkali soap or the like used in the invention is an alkali metal salt, ammonium salt or water soluble ester of a fatty acid. As the fatty acid, saturated fatty acids or unsaturated fatty acids having 8 to 22, particularly 16 to 20 carbon atoms are preferred, and there can specifically mentioned octanoic acid, decanoic acid, lauric acid, myristic acid, palmitic acid, stearic acid, eicosanoic acid, oleic acid, etc. As the alkali metal, sodium, potassium and lithium are preferred. As the water soluble ester, there can be mentioned an ester obtained by ring-opening polymerizing ethylene oxide to the carboxyl group of the above fatty acid, etc. As preferred specific examples of the alkali soap or the like, there can be mentioned a sodium or potassium salt of palmitic acid, stearic acid or eicosanoic acid, and most preferred among them is sodium stearate. Sodium stearate may include both pure one and one containing sodium salts of other fatty acids. As the latter sodium stearate, sodium stearate put on the market as C18 soap is mentioned, and its composition is 95% or more of sodium stearate, less than 3% of $C_{16}$ fatty acids and less than 1% of mixed $C_{15}$ and $C_{17}$ fatty acids.

The present invention also relates to powder consisting of the above coated particles (namely, the above two-layer particles or three-layer particles).

The present invention also relates to a suspension wherein the above two-layer particles are suspended in water or an aqueous solution of an alkali soap or the like, the average particle size of the particles of the inorganic polyvalent metal compound being 20 μm or less. The average particle size of the particles of the inorganic polyvalent metal compound in the two-layer particles is preferably 10 μm or less. When the average particle size is more than 20 μm, it gets difficult to maintain the water suspension state stably. The proportion of metallic soap coatings to all the two-layer particles in the suspension is preferably 1 to 30% by mass, more preferably 2 to 15% by mass, as is the case of the above-mentioned two-layer particles. It is possible to compound into the suspension a surfactant, a dispersant, a water soluble resin or the like in view of further heightening the stability of the dispersoid. The proportion of the two-layer particles to the whole suspension is not particularly limited so long as stable suspension of the two-layer particles is maintained, but, usually, is preferably on the order of 1 to 50% by mass, more preferably on the order of 5 to 40% by mass.

Description is made bellow on processes for preparation of the above powder and suspension of the invention.

The powder of the invention can be obtained by suspending particles of the above inorganic polyvalent metal compound in an aqueous solution of an alkali soap or the like, stirring the resulting suspension under heating to form metallic soap coating on the surfaces of the particles of the inorganic polyvalent metal compound, and drying the suspension.

As to use amount of the alkali soap or the like to the inorganic polyvalent metal compound, the alkali soap or the like may be used so that the above-mentioned proportion of the metallic soap to the coated particles may be obtained, but, specifically, it is preferred that the mole ratio of the inorganic polyvalent metal compound:the alkali soap or the like is the range of 100:0.05 to 100:25. When the amount of the alkali soap or the like is less than 100:0.05, the amount of the metallic soap layer gets extremely small, and expected effect tends not to be exerted sufficiently. When the amount of the alkali soap or the like is more than 100:25, the efficiency of the coating reaction is extremely reduced to bring about economical disadvantage. When the powder of the invention is used in lubricant use, the mole ratio of the inorganic polyvalent metal compound:the alkali soap or the like is preferably in the range of 100:0.25 to 100:15. When the amount of the alkali soap or the like is less than 100:0.25, sufficient lubrication performance tends hard to obtain, and it is more than 100:15, such problems tend to occur that the foaming properties of the suspension gets high due to existence of a lot of unreacted alkali soap or the like, and so on.

For accelerating reaction in preparation of the powder, it is preferred to adjust the temperature of the suspension to 60° C. or more, particularly 70 to 100° C., and the pH to 9 or more, particularly 10 to 12. As to the mechanism of the reaction, it is presumed that, on particles of the inorganic polyvalent metal compound, double decomposition reaction between the inorganic polyvalent metal compound and the alkali soap or the like takes place, and metallic soap layers coat the particles of the inorganic polyvalent metal compound as nuclei. For making the pH the above-mentioned alkali side, there can be used hydroxides (sodium hydroxide, potassium hydroxide, etc.), carbonates (sodium carbonate, potassium carbonate, etc.), bicarbonates (sodium bicarbonate, potassium bicarbonate, etc.) of alkali metal, aqueous ammonia, etc., and preferred among them is sodium hydroxide. After surfaces of the particles of the inorganic polyvalent metal compound are coated with a preferred amount of metallic soap coatings, the suspension is dried into powder, and the method of the drying may be a conventional one. For example, a method of filtering the suspension and drying the resulting solid, a method of spray drying the suspension, or the like can be adopted.

Powder obtained by the above-mentioned process for preparing the powder of the invention is, usually, powder of three-layer particles consisting of the inorganic polyvalent metal compound, the metallic soap and the alkali soap or the like. Powder of two-layer particles consisting of the inorganic polyvalent metal compound and the metallic soap can be prepared by washing away the alkali soap or the like composing the outermost layer of the three-layer particles obtained in a way as mentioned above, with hot water, aqueous alcohol solution or the like.

The suspension of the invention can be obtained by suspending particles of the inorganic polyvalent metal compound in an aqueous solution of an alkali soap or the like, and stirring the suspension under heating to form metallic soap coating on the surfaces of the particles of the inorganic polyvalent metal compound. In this case, for suspending the particles of the inorganic polyvalent metal compound stably, the particle size of the particles of the inorganic polyvalent metal compound needs to be adjusted to 20 μm or less, and is preferably adjusted to 10 μm or less. For further stabilizing the suspension state, it is possible to compound a surfactant, a dispersant, a water soluble resin or the like.

The use amount of the alkali soap or the like to the inorganic polyvalent metal compound, the temperature and pH of the suspension for accelerating the reaction, and additives for making the pH the above-mentioned alkaline side may be the same as in the case of the preparation of the powder of the invention.

The powder and suspension relating to the metallic soap of the invention exert excellent performance as lubricants used in the cold plastic working field, etc. Namely, coating formed by making the powder or suspension of the invention adhering to the surface of a material to be subjected to cold plastic working shows excellent performance as lubricating coating for cold plastic working. When the powder of suspension is used for forming lubricating coating, the powder or suspension alone can be made into coating, but it can also be made into coating together with other general ingredients such as lubricating waxes, solid lubricants, extremely pressure additives, coating forming resins and/or viscosity adjusting agents. For example, by using the powder or suspension together with a lubricating oil containing a mineral oil or palm oil as a main ingredient, or a olefin wax or high molecular wax which melts and is liquidized at the time of working, it is possible to give the latter (i.e., the lubricating oil, etc.) excellent seizure resistance.

When the powder or suspension of the invention is compounded into a lubricating coating to give it seizure resistance, the compounding is preferably made so that the content of the powder or the solid matter in the suspension in the resulting coating may be 1% by mass or more, particularly 5% by mass or more. When the compounding proportion of the powder or the solid matter in the suspension is less than 1% by mass, it is impossible to give the lubricating coating sufficient seizure resistance. Although the conditions for the adhesion are not particularly limited, the dry coating thickness of the lubricating coating is preferably made to be in the range of 0.5 to 50μm, more preferably made to be in the range of 1.0 to 30 μm. When the coating thickness is less than 0.5 μm, there is an anxiety that, especially in the strong working field, sufficient seizure resistance cannot be obtained to cause poor working. Further, the coating thickness of more than 50 μm is superfluous and only increases the amount of the coating peeling away at introduction into the tool, and, thus, tends to bring about economical disadvantage.

A method for forming, on the surface of a material to be wrought, lubricating coating containing the powder or solid matter in the suspension of the invention is not particularly limited, and a conventional method can be adopted. For example, in the case of the aqueous suspension, lubricating coating can be obtained by making the aqueous suspension adhere onto the surface of the material by immersion treatment, spraying, roll coater treatment or the like, and then drying the resulting wet coating by natural seasoning, compulsory hot air drying or the like. In this operation, it is possible to mix a resin, an inorganic salt or the like for heightening the adhesion of the powder or the solid matter in the suspension, or an oil, a soap, a metallic soap, a wax or the like for supplementing the lubricity of powder or the solid matter in the suspension.

Further, as to a method for forming coating solely from the powder in a dry state, the powder of the invention can be made to adhere by a powder box method, an electrostatic coating method or the like, and an electrostatic coating method is particularly preferred because control of adhesion properties and adhesion amount is easy and stable and uniform lubricating coating can be obtained. It is also possible to mix a resin ingredient or wax ingredient having a low melting point, when the powder is made to adhere, for preventing peeling of the powder from the surface of the material to be wrought, and then heat the material to be wrought to immobilize the powder. It is also possible to mix powder of soap, metallic soap, wax, resin or the like for supplement of lubricity. Further, it is possible to obtain lubricating coating of a continuous coating state, through working heat and pressure, by, after making the powder of the invention adhere, subjecting the material to be wrought to light plastic working of the order of skin pass; and the operation is preferred since the resulting coating is coating further excellent in lubrication performance and barrier performance such as corrosion resistance. Particularly, lubricating coating obtained by a combination of electrostatic coating method and light plastic working of the order of skin pass is equal to "coating of phosphating treatment plus soap treatment" in all performance aspects. In this occasion, coating obtained after mixing the powder with a high molecular synthetic wax in a ratio by mass of preferably 1:9 to 9:1, more preferably 1:1 to 9:1 is excellent in lubricity, oil resistance, etc.

Detailed Description Particularly on the Invention as a More Practical Applied Invention The invention is described in detail below. The particles of the invention each of which consists of a polyvalent metal salt of phosphoric acid as a nucleus and a metallic soap of the polyvalent metal coating the nucleus, namely particles of coated polyvalent metal salt of phosphoric acid give the resulting coating heat resistance and lubricity. It is necessary for a polyvalent metal salt of phosphoric acid to be selected to be sparingly soluble or insoluble in water. As preferred examples of the polyvalent metal in the polyvalent metal salt of phosphoric acid, there can be mentioned Zn, Fe, Mn, Ni, Co, Ca, Mg, Ba, Al and Sn, and further preferred among them are Zn, Fe and Ca. As specific examples of the polyvalent metal salt of phosphoric acid, there can be mentioned zinc phosphate, iron zinc phosphate, iron phosphate (ferrous phosphate, ferric phosphate), manganese phosphate, nickel phosphate, cobalt phosphate, calcium phosphate, calcium hydrogenphosphate, magnesium phosphate, magnesium hydrogenphosphate, barium phosphate, barium hydrogenphosphate, aluminum phosphate, tin phosphate, etc., and preferred among them are zinc phosphate, iron zinc phosphate, iron phosphate (ferrous phosphate, ferric phosphate), calcium phosphate and calcium hydrogenphosphate. These can be used alone or in combination of two or more.

The particles of the coated polyvalent metal salt of phosphoric acid exist in coating obtained by applying the lubricating coating forming agent of the invention onto a metallic material to be subjected to cold plastic working, and give the metallic material seizure resistance and lubricity; and, after being introduced into a die by melted coating ingredients at the time of working, exert an action to repair coating defects, namely a self-repairing action. For these purposes, in a state suspended in water or an aqueous solution of an alkali soap or the like, the average particle size of the particles of the coated polyvalent metal salt of phosphoric acid is preferably 30 μm or less, more preferably 0.3 to 30 μm and still more preferably 0.5 to 20 μm. The average particle size of the polyvalent metal salt of phosphoric acid in the particles of the coated polyvalent metal salt of phosphoric acid is preferably 20 μm or less, more preferably 0.2 to 20 μm and still more preferably 0.4 to 10 μm. Furthermore, for giving sufficient lubricity, the proportion by mass of the metallic soap coatings to all the particles of the coated polyvalent metal salt of phosphoric acid is preferably 1 to 30%, more preferably 2 to 15%.

The particles of the coated polyvalent metal salt of phosphoric acid are included in "two-layer particles" in the present invention particularly as a fundamental invention, and can be prepared in a similar way as in the two-layer particles.

Next, the water soluble inorganic salt needs to have not only a property to give the lubricating coating hardness but also a property to immobilize the particles of the coated polyvalent metal salt of phosphoric acid in the coating. A water soluble inorganic salt selected therefor needs to have a property to dissolve in water uniformly and, when the solution is applied onto a metallic material and dried, form firm coating. It is preferred to use, as the water soluble inorganic salt having such properties, at least one selected from the group consisting of alkali metal salts of sulfuric acid, alkali metal salts of silicic acid and alkali metal salts of boric acid. As specific examples thereof, there can be mentioned sodium sulfate, potassium sulfate, sodium silicate, potassium silicate, sodium borate, potassium borate, etc., and these can be used alone or in combination of two or more.

The water soluble organic acid salt needs to have a property not only to give hardness to the lubricating coating, but to immobilize the particles of the coated polyvalent metal salt of phosphoric acid in the coating. A water soluble organic acid salt selected therefor needs to have a property to dissolve in water uniformly and, when the solution is applied onto a metallic material and dried, form firm coating. It is preferred to use, as the water soluble organic acid salt having such properties, at least one selected from the group consisting of alkali metal salts of malic acid, alkali metal salts of succinic acid, alkali metal salts of citric acid and alkali metal salts of tartaric acid. As more specific examples thereof, there can be mentioned sodium malate, potassium malate, sodium succinate, potassium succinate, sodium citrate, potassium citrate, sodium tartrate, potassium tartrate, etc.

The compounding proportion between the particles of the coated polyvalent metal salt of phosphoric acid (A) and the total of the water soluble inorganic salt and the water soluble organic acid salt (B) as a ratio by mass in solid matter of (B)/(A) is preferably 0.01 to 20.0, more preferably 0.01 to 16.0 and still more preferably 0.01 to 7.5. At less than 0.01, the particles of the coated polyvalent metal salt of phosphoric acid are not immobilized in the coating, the water soluble inorganic salt of the lubricating coating is not drawn into the tool against shear onto the coating at the time of working, and seizure resistance gets insufficient. On the other hand, at more than 20.0, since a probability that the water soluble inorganic salt having a high friction coefficient exists on the coating surface gets extremely high, the friction coefficient of the coating gets high, the coating gets easy to break and seizure gets liable to occur.

The lubricating coating forming agent of the invention may contain a smectite clay mineral according to necessity, and it is usually preferred to incorporate it. The smectite clay mineral used in the invention is a clay mineral having the following general formula. ("Clay Handbook 2nd edition" edited by Japan Clay Society and published by Gihodo Publishing CO., Ltd., pages 58-66, 1987): $X_m(Y^{2+}, Y^{3+})_{2-3}Z_4O_{10}(OH)_2.nH_2O$ wherein X is at least one of K, Na, ½ Ca and ½ Mg, m is 0.25 to 0.6, $Y^{2+}$ is at least one of $Mg^{2+}$, $Fe^{2+}$, $Mn^{2+}$, $Ni^{2+}$, $Zn^{2+}$ and $Li^{+}$, $Y^{3+}$ is at least one of $Al^{3+}$, $Fe^{3+}$, $Mn^{3+}$ and $Cr^{3+}$, Z is at least one of Si and Al, and $nH_2O$ is water among layers. $Y^{2+}$, $Y^{3+}$ in $(Y^{2+}, Y^{3+})$ means $Y^{2+}$ and/or $Y^{3+}$. Further, in the above, X represents a cation among the layers, Y is a cation of the octahedron and Z is a cation of the tetrahedron.

The smectite clay mineral used in the invention needs to have a property to give dispersion stability in liquid to the particles of the coated polyvalent metal salt of phosphoric acid and stabilize distribution of the particles in the coating. Therefor, formation of stable sol in an aqueous phase and increase of viscosity accompanying sharp increase of the concentrations of the contained ingredients get necessary. Smectite clay minerals generally show the above-mentioned properties when dispersed in an aqueous phase, and as smectite clay minerals having such properties, it is preferred to use at least one selected from the group consisting of hectorite, montmorillonite, beidellite, nontronite, saponite, iron saponite, stevensite and sauconite. Smectite clay minerals can be obtained not only as natural resources but as synthetic ones, and both can be used in the invention.

The compounding proportion of the smectite clay mineral as s a ratio by mass in terms of solid matter of (C)/(A) wherein (A) are the particles of the coated polyvalent metal salt of phosphoric acid and (C) is the smectite clay mineral is preferably 0.005 to 0.5, more preferably 0.01 to 0.4. At less than 0.005, an effect to improve the dispersion stability of the particles of the coated polyvalent metal salt of phosphoric acid in the liquid and an effect to stabilize the distribution in the coating are not sufficient, and at more than 0.5, the lubricating coating forming agent gets a paste state to make its stable use difficult.

The lubricating coating forming agent of the invention may contain an auxiliary lubricant according to necessity, and, usually, it is preferred to incorporate it in the agent. The auxiliary lubricant needs to have an action to lower the friction coefficient of lubricating coating formed by the lubricating coating forming agent of the invention, and, as a melt carrier introducing the particles of the coated polyvalent metal salt of phosphoric acid between the material to be wrought and the tool, help the self-repairing effect of the coating. Therefor, the auxiliary lubricant, as one which melts with heat generated at the time of plastic working to give the coating slipping properties and acts as a melt carrier, is preferably at least one selected from the group consisting of oil, soap, metallic soap, wax and polytetrafluoroethylene. As the oil, there can be used vegetable oils, synthetic oils, mineral oils, etc., and there can, for example, be mentioned palm oil, castor oil, rapeseed oil, machine oil, turbine oil, spindle oil, ester oil, silicone oil, etc. The soap is an alkali metal salt of a fatty acid, and there can, for example, be mentioned sodium salts, potassium salts, etc. of saturated or unsatureated fatty acids having 8 to 22 carbon atoms such as octanoic acid, decanoic acid, lauric acid, myristic acid, palmitic acid, stearic acid, eicosanoic acid and oleic acid. As the metallic soap, there can be mentioned salts of polyvalent metals such as calcium, zinc, magnesium and barium with the above-mentioned fatty acids. As the wax, there can be mentioned polyethylene wax, polypropylene wax, carnauba wax, paraffin wax, etc. As the polytetrafluoroethylene, there can be mentioned polytetrafluoroethylene having a molecular weight of the order of 1,000,000 to 10,000,000. It is preferred that such an auxiliary lubricant is incorporated in the lubricating coating forming agent by mixing it in the form of aqueous emulsion or aqueous dispersion with other ingredients. The auxiliary lubricant is usually dispersed or emulsified in the lubricating coating forming agent of the invention.

The compounding proportion of the auxiliary lubricant as s a ratio by mass in terms of solid matter of (D)/(A) wherein (A) are the particles of the coated polyvalent metal salt of phosphoric acid and (D) is the auxiliary lubricant is preferably 0.03 to 18.0, more preferably 0.05 to 15.0 and still more preferably 0.5 to 5.0. At less than 0.03, the friction coefficient of the lubricating coating is increased and the effect to act as a melt carrier is not sufficient, and at more than 18.0, the coating is softened, and the coating tends to be broken because it gets incapable of withstanding shearing force thereon at the time of working.

The lubricating coating forming agent of the invention may contain an organic high molecular compound according to necessity. It is preferred that the organic high molecular compound is water soluble or water dispersible and has a weight average molecular weight of 1,000 to 1,000,000. The organic high molecular compound needs to have an action to give coating strength to lubricating coating formed using the lubricating coating forming agent. The organic high molecular compound is not particularly limited so long as it has coating formability, and there can, for example, be mentioned resin as a polymer of ethylenically unsaturated monomer(s) (particularly, acrylic resin), urethane resin, epoxy resin, phenol resin, hydroxymethylcellulose, carboxymethylcellulose, etc. It is preferred that such an organic high molecular compound is incorporated in the lubricating coating forming agent by mixing it in the form of aqueous emulsion or aqueous dispersion with other ingredients. In view of improving the coating strength of coating formed by the lubricating coating forming agent, the organic high molecular compound is added into the lubricating coating forming agent so that its content can be preferably 0.5 to 25% by mass, more preferably 1.0 to 15% by mass based on the whole solid matter including itself.

In plastic working wherein the working is severe, it is possible to further incorporate a solid lubricant in the lubricating coating forming agent. As the solid lubricant in such a case, one existing stably in the coating and capable of assisting lubrication at a high load is preferred. As such solid lubricants, there can be mentioned graphite, molybdenum disulfide, boron nitride, fluorinated graphite, mica, etc.

In plastic working wherein the working is severer, it is possible to incorporate an extremely pressure additive in the lubricating coating forming agent. As the extremely pressure additive in such a case, one existing stably in the coating and capable of exerting extreme-pressure effect at the contact surface between the tool and the metal is preferred. As such extremely pressure additives, there can be mentioned sulfur containing extremely pressure additives, organomolybdenum extremely pressure additives, phosphorus containing extremely pressure additives and chlorine containing extremely pressure additives such as sulfurized olefins, sulfurized esters, sulfites, thiocarbonates, chlorinated fatty acids, phosphoric esters, phosphorous esters, molybdenum dithiocarbamate (MoDTC), molybdenum dithiophophate (MoDTP) and zinc dithiophosphate (ZnDTP).

When a dispersant is necessary to disperse or emulsify the particles of the coated polyvalent metal salt of phosphoric acid, the auxiliary lubricant, and/or the solid lubricant and/or extremely pressure additives, as such a dispersant, there can be used a dispersant selected from nonionic surfactants, anionic surfactants, amphoteric surfactants, cationic surfactants, water soluble high molecular dispersants and so on.

There is no particular limitation on a process for preparing the lubricating coating forming agent of the invention so long as a lubricating coating forming agent prepared meets the above-mentioned conditions. For example, the agent can be obtained by adding particles of a coated polyvalent metal salt of phosphoric acid, and, as optional ingredients, a smectite clay mineral, an auxiliary lubricant, and/or a solid lubricant and/or an extremely pressure additive, if necessary after being made into a dispersion or emulsion using a dispersant and water, into an aqueous solution of a water soluble inorganic salt and/or a water soluble organic acid salt; and then stirring the resulting mixture. The solid matter concentration of the lubricating coating forming agent is not particularly limited so long as the lubricating coating forming agent prepared meets the above-mentioned conditions, but, in view of handling properties and stability of the lubricating coating forming agent, the solid matter concentration is preferably 1 to 80% by mass, more preferably 10 to 60% by mass.

The lubricating coating forming agent of the invention can be used as a lubricant used when a metallic material such as iron or steel, stainless steel, plated steel (for example, steel subjected to plating treatment such as electrogalvanizing, molten zinc plating, aluminum zinc plating, aluminum plating or iron zinc plating), aluminum or aluminum alloy, magnesium alloy, tin or tin alloy, titanium or titanium alloy, or copper or copper alloy is subjected to cold plastic working such as forging, wire drawing, tube reducing or sheet forming. There is no particular limitation on the shape of the metallic material.

For exerting good lubricity, it is preferred, prior to applying the lubricating coating forming agent of the invention, to pretreat a metallic material to be worked in order of cleaning (usually, an alkali cleaner is used), water washing, descaling (shot blasting or acid washing with hydrochloric acid or the like) and water washing to clean the surface of the metallic material. When oxidation scale does not adhere or the metallic material is used in a use where oxidation scale is needed, descaling and succeeding water washing can be omitted. These pretreatments can be carried out by conventional ways.

The lubricating coating forming agent of the invention is applied to the surface of a metallic material by a conventional method such as immersion, spraying or 流しかけ. The application is carried out until the metal surface is sufficiently coated with the lubricating coating forming agent, and there is no particular limitation on time of the application. After the application, the lubricating coating forming agent needs to be dried. The drying may be made by allowing the coating to stand at ordinary temperature, but, usually, is preferably made at 60 to 150° C. for 10 to 60 minutes. In view of preventing seizure, the coating mass of the lubricating coating forming agent is preferably 1 g/m$^2$ or more, more preferably 3 to 30 g/m$^2$.

Lubricating coating obtained from the lubricating coating forming agent of the invention shows stable cold plastic working performance because the particles of the coated polyvalent metal salt of phosphoric acid having good seizure resistance and slipping properties are uniformly held in the coating by immobilizing effect of the water soluble inorganic salt and/or the water soluble organic acid salt, and the smectite clay mineral. Furthermore, since, because the auxiliary lubricant ingredient melting by heat generation due to working acts as a melt carrier, and so on, the particles of the coated polyvalent metal salt of phosphoric acid are drawn into the die and exert a self-repairing action on coating defect parts, the lubricating coating shows stable lubricity, even in tube drawing working such as tube reducing or wire drawing wherein lubricating coating forming treatment is, usually, carried out in such a state such as a banded state or a coiled state that the resulting coating is liable to be ununiform.

EXAMPLES

The present invention is further specifically described below together with its effects, by giving examples of the invention together with comparative examples.

I. Examples and Comparative Examples on the Invention as a Fundamental Invention 1. Preparation of Suspension and Powder of Metallic Soap-Coated Particles A suspension and powder of metallic soap-coated particles were prepared according to the processes shown below. For confirming that coated particles, wherein nuclei of the inorganic polyvalent metal compound are coated with coatings of the metallic soap, are prepared, soap ingredients in the powder prepared or soap ingredients in the powder obtained by drying the suspension prepared were separated into alkali soap or the like dissolving in an aqueous ethanol solution and metallic soap not dissolving therein, and the mass of each was measured, whereby formation of metallic soap was confirmed. The above method is explained in more detail below. One gram of a powder sample was stirred in aqueous 50% ethanol solution for 4 hours, and the mixture was filtered with filter paper. Then, the filtrate and the residue were heated in 1N hydrochloric acid, respectively, to decompose the soap ingredients into fatty acid(s). Each of the mixtures was extracted with diethyl ether, and the proportion of metallic soap formation=([(fatty acid(s) from the metallic soap)/(fatty acid(s) from the alkali soap or the like+fatty acid(s) from the metallic soap)]×100) was calculated. When the proportion of metallic soap formation is 50% or more, it was judged that the nuclei surfaces were coated with a sufficient amount of metallic soap layers.

(A1)

Ten grams of sodium stearate and 1 g of sodium hydroxide were mixed with 100 g of particles of zinc phosphate having an average particle size of 1 μm and dispersed in 1 L of water, and the mixture was stirred at a liquid temperature of 90 to 95° C. for 30 minutes to obtain a suspension of metallic soap-coated particles.

※ Proportion of metallic soap formation=82% (this value corresponds to about 8% as the proportion by mass of metallic soap coatings based on all the two-layer particles)

(A2)

Two hundred grams of zinc phosphate powder, 30 g of potassium stearate and 1 g of potassium hydroxide were dispersed into 700 mL of water under stirring, and the mixture was stirred at a liquid temperature of 70° C. for 1 hour. Solid matter was recovered by filtration, and stirred for 4 hours in aqueous 50% ethanol solution, and, by second filtration, solid matter was obtained. This was dried in an oven of 100° C. to obtain dry powder of metallic soap-coated particles containing no layer of the alkali soap.

※ Proportion of metallic soap formation=78% (this value corresponds to about 10% as the proportion by mass of metallic soap coatings based on all the two-layer particles).

(A3)

Two hundred grams of zinc oxide, 10 g of sodium stearate and 3 g of sodium hydroxide were dispersed into 700 mL of water under stirring, and the mixture was stirred at a liquid temperature of 90° C. for 20 minutes. Then, solid matter was recovered by filtration and dried in an oven of 100° C. to obtain dry powder of metallic soap-coated particles.

※ Proportion of metallic soap formation=53% (this value corresponds to about 3% as the proportion by mass of metallic soap coatings based on all the three-layer particles)

2. Test on Resistance to Oil Pollution

As one of the problems which the powder of the metallic soap-coated particles of the invention aims to solve, there is resistance to pollution of oil. This aims to solve a pollution phenomenon of working oil which metallic soap has as a drawback, by using the above powder for lubricant use in place of conventional metallic soap. A test method and evaluation criterion therefor are given below. One gram of one of the prepared powders of metallic soap-coated particles or 1 g of one of metallic soap powders on the market shown below was added to 100 g of former oil on the market, and the mixture was left alone in a stirring state at 60° C. Then, the stirring was stopped, and, under a suspension state of the oil at 1 hour after, resistance to oil pollution was evaluated. The sooner the suspended matter can be precipitated, the better.

Evaluation criterion: A: the suspended matter is completely precipitated, and the transparent layer occupies 95% or more of the whole volume. B: the suspended matter is precipitated, and the transparent layer of less, than 95% of the whole volume can be recognized. C: the oil is in a suspension state, and no transparent layer can be recognized.

Evaluation results of the test on resistance to oil pollution on Examples I-1 and I-2 of the invention and Comparative examples I-1 and I-2 are shown in Table 1. The powders of metallic soap-coated particles of the invention mentioned in the examples were very excellent in resistance to oil pollution. The reason is presumed to be that the metallic soap layers are immobilized on the surfaces of the particles of the inorganic polyvalent metal compound, and thus it gets hard for the metallic soap layers to peel off into the oil. On the other hand, calcium stearate powder (B3) and zinc stearate powder (B6) of the comparative examples are metallic soap powders having no nucleus, and, thus, got to be in a swollen state in the oil, and continued to be suspended in the oil by being finely dispersed.

TABLE 1

| | Sample powder | Results of resistance to oil pollution |
|---|---|---|
| Example I-1 | A2 | A |
| Example I-1 | A3 | A |
| Com. exam. I-1 | B3 | C |
| Com. exam. I-2 | B6 | C |

Note:
Com. exam.: Comparative example

3. Evaluation as Lubricating Coating Forming Material

The compositions of the lubricating coatings of Examples I-3 to I-9 obtained by using, as lubricating coating forming materials, the suspension of the metallic soap-coated particles of the invention prepared in the above or the powders of the metallic soap-coated particles of the invention prepared in the above, and the compositions of the lubricating coatings of Comparative examples I-3 to I-7 not using suspension of metallic soap-coated particles nor powder of metallic soap-coated particles of the present invention are shown in Table 2.

3.1. Lubricating Coating Forming Material

Lubricating coating forming materials used in the present test are shown below.

(A1) The suspension of the metallic soap-coated particles of the invention obtained in the above
(A2) The powder of the metallic soap-coated particles of the invention obtained in the above
(A3) The powder of the metallic soap-coated particles of the invention obtained in the above
(A4) Aqueous suspension of zinc phosphate particles having an average particle size of 0.5 μm
(A5) Zinc oxide powder having an average particle size of 50 μm
(B 1) Water-dispersed polyethylene wax
(B2) Water-dispersed olefin wax
(B3) Calcium stearate powder
(B4) Montanic acid wax powder
(B5) Oxidized polyethylene wax powder
(B6) Zinc stearate powder
(C1) Sodium polyacrylate (molecular weight 10,000)
(C2) Aqueous emulsion of urethane resin (polyester urethane resin)

3.2. Treating Method

For forming lubricating coating of an example of the invention or a comparative example on the surface of a test material, one of the following treating methods was used.

(a) Immersion Treatment Method

A test piece whose surface was cleaned was immersed in lubricating coating forming suspension of ordinary temperature to make the suspension adhere thereon, and was subjected to drying in a hot air drying furnace of 100° C. to form lubricating coating on the surface of the test piece. The amount of the dry coating adhering was about 15 g/m$^2$.

(b) Electrostatic Coating Method

A test piece whose surface was cleaned was electrostatically coated with lubricating coating forming powder to form lubricating coating in a powder adhesion state on the surface of the test piece. As an electrostatic powdering apparatus, GX300 made by Nihon Parkerizing Co., Ltd was used, and the lubricating coating forming powder was charged at a voltage of 60 kV. Adhesion of the charged lubricating coating forming powder on the surface of the test piece by an electrostatic coating method was carried out using an electrostatic coating gun GX116 made by Nihon Parkerizing Co., Ltd. Air pressures for supply of the powder in this operation were 98 kPa as the main air pressure and 196 kPa as the sub-air pressure. The coating time was 1 second, and the amount of the powder coating adhering was about 15 g/m$^2$.

3.3. Test Method and Evaluation Criterion 3.3.1. Spike Test

Spike test working was made according to the method disclosed in JP 5-7969 A, and lubricity was evaluated by the spike height of the test piece after the working. The higher the spike height is, the better the lubricity is.

Test piece: A material used for the test was annealed S45C material which was made spherical and commercially available, and the shape of the test piece was 25 mm ϕ in diameter and 30 mm in height.

Evaluation criterion: A: Spike height was 13 mm or more
B: Spike height was 12 mm or more but less than 13 mm
C: Spike height was less than 12 mm
D: The material was seized onto the die, resulting in molding being impossible 3.3.2. Drawing Test Steel wire as a test piece coated with a lubricating coating was subjected to drawing working of the order of skin pass (first drawing: reduction in area being 10.3%), and, then, subjected to drawing working of reduction in area being 31.5% (second drawing), using a draw bench drawing testing machine on the market.

Test piece: A material used for the test was SCr440 material on the market, and the shape of the test piece was 9.5 mm ϕ in diameter and 1 m in length.

Evaluation criterion:
A: Seizure and flaws were not found up to the second drawing
B: Seizure was not found up to the second drawing, but some flaws were found.
C: Seizure and flaws were not found up to the first drawing, but seizure occurred at the second drawing resulting in drawing being impossible
D: Seizure occurred at the first drawing resulting in drawing being impossible

TABLE 2

| | | Composition of lubricating film | | | |
|---|---|---|---|---|---|
| | | Seizure resisting ingredient (compounding amount %) | Lubricant ingredient (compounding amount %) | Other ingredient (compounding amount %) | Treating method |
| Example | I-3 | A1 (100) | — | — | a |
| | I-4 | A1 (50) | B1 (45) | C1 (5) | a |
| | I-5 | A1 (20) | B2 (70) | C2 (10) | a |
| | I-6 | A2 (100) | — | — | b |

TABLE 2-continued

| | | Composition of lubricating film | | | |
|---|---|---|---|---|---|
| | | Seizure resisting ingredient (compounding amount %) | Lubricant ingredient (compounding amount %) | Other ingredient (compounding amount %) | Treating method |
| | I-7 | A2 (80) | B4 (20) | — | b |
| | I-8 | A3 (50) | B5 (50) | — | b |
| | I-9 | A3 (30) | B4 (60) | C1 (10) | b |
| Com. exam | I-3 | A4 (100) | — | — | a |
| | I-4 | A4 (50) | B1 (45) | C1 (5) | a |
| | I-5 | A5 (100) | — | — | b |
| | I-6 | A5 (50) | B3 (50) | — | b |
| | I-7 | A5 (30) | B5 (70) | — | b |

Note:
The compounding amount of each ingredient is compounding amount as solid matter
Com. exam.: Comparative example

TABLE 3

| | | Results of evaluation as lubricating film forming material | |
|---|---|---|---|
| | | Spike test | Drawing test |
| Example | I-3 | B | B |
| | I-4 | A | A |
| | I-5 | A | A |
| | I-6 | B | B |
| | I-7 | A | A |
| | I-8 | B | B |
| | I-9 | A | B |
| Com. exam. | I-3 | D | D |
| | I-4 | C | C |
| | I-5 | D | D |
| | I-6 | C | D |
| | I-7 | C | C |

Note:
Com. exam.: Comparative example

As shown in the above results of evaluation (see Table 3), each of the lubricating coatings of Examples I-3 to I-9 obtained by using the metallic soap compositions of the invention which play a role of seizure resisting ingredient and, at the same time, also have lubricating performance, showed good lubricating performance. On the other hand, in Comparative examples I-3 to I-7, because of exposure of the seizure resisting ingredient having high friction coefficient, the resulting lubricating coatings could not exert sufficient performance as lubricating coating being subjected to strong working, and, moreover, load to the tool is judged to be high.

As apparent from the above explanation, the coated particles of the invention consisting of an inorganic polyvalent metal compound as a nucleus, and metallic soap coating or metallic soap coating plus coating of alkali soap or the like on it coating the nucleus, are mainly used as ingredients for coating type lubricating coating, and are suitable as materials which are excellent in seizure resistance, and, because of their low surface friction coefficient, can inhibit wear of tools at the time of plastic working, and do not easily cause pollution of working oil. Therefore, the industrial utility value of the present invention is extremely great.

II. Examples and Comparative Examples on the Invention as a Particularly Practical Applied Invention

Examples II-1 to II-12 and Comparative Examples II-1 to II-9

Lubricating coating forming agents of ingredients and their compositions shown in Table 4 were prepared.

<Coating of Polyvalent Metal Salt of Phosphoric Acid With Metallic Soap>

As to Examples II-1 to II-12 and Comparative examples II-1, II-2, II-5 and II-6, coating of a polyvalent metal salt of phosphoric acid [ingredient (A)] with metallic soap was carried out (Table 4). Specifically, 90 g of a polyvalent metal salt of phosphoric acid having an average particle size of 1 to 5 μm dispersed in 1 L of water, 9 g of sodium stearate and 1 g of potassium hydroxide were mixed and stirred at a liquid temperature of 80 to 85° C. for 30 minutes to obtain a suspension of particles of coated polyvalent metal salt of phosphoric acid.

<Preparation of the Lubricating Coating Forming Agent of Example II-1>

Preparation of a lubricating coating forming agent was made so that the respective ingredients got to be the ratios of Table 4. The procedure of the preparation is as follows. First, the water soluble inorganic salt was dissolved in water, and then the smectite clay mineral was incorporated in the solution and uniformly dispersed. Thereafter, the above suspension of particles of coated polyvalent metal salt of phosphoric acid was incorporated in the suspension, and then the auxiliary lubricant was added, and the mixture was stirred to prepare the lubricating coating forming agent of Example II-1. As to starting materials used in Example II-1, the polyvalent metal salt of phosphoric acid is zinc phosphate (solid), the water soluble inorganic salt is aqueous 50% by mass sodium silicate dispersion, and the smectite clay mineral is montmorillonite (solid).

The lubricating coating forming agents of Examples II-2 to II-12 and Comparative examples II-1 to II-7 were prepared in the similar manner as above. The lubricating coating forming agents of Comparative example II-8 is an existing coating-type lubricating coating forming agent, and the lubricating coating forming agent of Comparative example II-9 is a phosphate salt plus soap treating agent on the market.

<Test Piece>

The following test pieces were used for the following evaluations.

Friction coefficient measuring test: SPCC-SB 150 mm×70 mm×0.8 mmt (t is thickness)

Evaluation of forging properties: S45C annealed material which was made spherical 30 mm ϕ×18 to 40 mm Tube reducing properties: STKM17A 25.4 mm ϕ×2.5 mmt×2,000 mm Wire drawing properties: S45C annealed material 3.0 mm ϕ×50,000 mm <Coating Forming Treatment> coating forming treatment was made according to the following steps.

In the Cases of Examples II-1 to II-12 and Comparative Example II-1 to II-8

(1) Cleaning: a degreasing agent on the market (registered trademark Fine Cleaner 4360, made by Nihon Parkerizing Co., Ltd.), concentration 20 g/L, temperature 60° C., immersion 10 minutes (2) Water washing: tap water, room temperature, immersion 30 seconds (3) Descaling: hydrochloric acid washing, concentration 17.5%, room temperature, immersion 10 minutes (4) Water washing: tap water, room temperature, immersion 30 seconds (5) Treatment: treating agent of an example or comparative example, room temperature, immersion 10 seconds, targeted adhesion amount 5g/$m^2$ (6) Drying: 80° C., 5 minutes In the Case of Comparative Example II-9

(1) Cleaning: a degreasing agent on the market (registered trademark Finecleaner 4360, made by Nihon Parkerizing Co., Ltd.), concentration 20 g/L, temperature 60° C., immersion 10 minutes (2) Water washing: tap water, room temperature, immersion 30 seconds (3) Descaling: hydrochloric acid washing, concentration 17.5%, room temperature, immersion 10 minutes (4) Water washing: tap water, room temperature, immersion 30 seconds (5) Chemical conversion coating treatment: Zinc phosphate chemical conversion coating agent on the market (registered trademark Palbond 181X, made by Nihon Parkerizing Co., Ltd.), concentration 90 g/L, temperature 80° C., immersion 10 minutes (6) Water washing: tap water, room temperature, immersion 30 seconds (7) Soap treatment: reactive soap lubricant on the market (registered trademark Palube 235, made by Nihon Parkerizing Co., Ltd.), concentration 70 g/L, temperature 80° C., immersion 5 minutes (8) Drying: 80° C., 3 minutes <Coating Performance Evaluation Test>

A friction coefficient measurement test was made, after the above coating forming treatment, according to a Bowden test which is the most standard friction coefficient measurement test. Since, in the Bowden test, there is a stable stage of friction coefficient after initial sliding, the friction coefficient at the stable stage was regarded as the friction coefficient of the lubricating coating. Measurement conditions in the test are as follows.

Sliding type: reciprocating sliding type

Steel sphere: 10 mmϕSUJ2 steel sphere

Vertical load: 50N

Sliding velocity: 10 mm/s

Temperature: 60° C.

Sliding number of times: 200 times

A forging test was made by a backward piercing test. The backward piercing test is such a test that cylindrical test pieces are subjected to backward piercing working wherein punches are knocked into the test pieces, the heights of the test pieces are varied from 18 mm up to 40 mm by every 2 millimeters, and possible working degree is determined. When seizure resistance is insufficient, flaws due to seizure are formed on the internal surfaces of the test pieces and on the punches. These flaws were checked by visual observation, and the highest height of the test pieces where no flaw is formed was evaluated as showing the lubricity of a lubricating coating forming agent. The treatment was carried out both by a method of treating test pieces separately one by one (one piece treatment) and by a method of treating plural pieces together in a rotary barrel (barrel treatment). Evaluation criterion is shown below. A and B are practical levels.

A: The workable height of the test piece is 40 mm or more.

B: The workable height of the test piece is 36 mm or more, but less than 40 mm.

C: The workable height of the test piece is 32 mm or more, but less than 36 mm.

D: The workable height of the test piece is less than 32 mm.

A tube reducing test was made by carrying out tube reducing working under the following conditions and making evaluation by such limiting reduction in area that no seizure was formed. The limiting reduction in area was assumed to be such reduction in area that three pipes were subjected to the tube reducing working and all the three. pipes could be worked. The treatment was carried out both by a method of treating pipes separately one by one (one pipe treatment) and by a method of treating three pipes in a bundled state (bundle treatment). Evaluation criterion is shown below. A and B are practical levels.

Die: R die

Plug: cylindrical plug.

Tube reducing velocity: 15 m/min.

A: The limiting reduction in area is 50% or more.

B: The limiting reduction in area is 43% or more, but less than 50%.

C: The limiting reduction in area is 38% or more, but less than 43%.

D: The limiting reduction in area is less than 38%.

A wire drawing test was made by carrying out wire drawing working under the following conditions and making evaluation by such limiting wire drawing velocity that stable wire drawing was possible. The coating treatment was carried out both by a method of extremely loosing the bundled state of the wire rod coil so that the wire rods could not contact mutually (a method of stretching the coil into a spring state; one rod treatment) and by a method of treating the wire rod coil in a bundled state so as to promote contact among the wire rods (bundled treatment). Evaluation criterion is shown below. A and B are practical levels.

Die: R die; 2.75 mm ϕ

Reduction in area: 15.0%

Wire drawing velocity: 10 to 100 m/min.

A: Limiting wire drawing velocity is 100 m/min or more.

B: Limiting wire drawing velocity is 80 m/min or more, but less than 100 m/min.

C: Limiting wire drawing velocity is 60 m/min or more, but less than 80 m/min.

D: Limiting wire drawing velocity is less than 60 m/min.

<Test Results>

Results of the above tests are shown in Table 5. As apparent from Table 5, the lubricating coating forming agents of the invention in Examples II-1 to II-12 showed good lubricity irrespective of working forms, and also showed stable lubricity even in the cases of barrel treatment and bundled treatment where uniform treatment was difficult. On the other hand, the lubricating coating forming agents of Comparative examples II-1 and II-2 which contain metallic soap-coated particles but no water soluble inorganic salt nor water soluble organic acid salt showed only low lubricity even when they were applied uniformly. Further, in Comparative examples II-3 and II-4 where the surfaces of particles of the polyvalent metal salt of phosphoric acid were not coated with metallic soap, since the friction coefficients of the particles were high and the self-repairing effect of the resulting coatings was not exerted, lubricity was not stable in the barrel treatment and the bundled treatment. The lubricating coating forming agents of Comparative examples II-5 and II-6 where calcium hydroxide or iron oxalate poor in solubility in water was used in place of a water soluble inorganic salt or a water soluble organic acid salt could not form continuous coating, and the resulting coatings are low in lubricity. In Comparative examples II-7 and II-8 where particles of a coated polyvalent metal salt of phosphoric acid are not contained, since the self-repairing effect of the resulting coatings was not exerted, lubricity was not stable in the barrel treatment and the bundled treatment. In the phosphating treatment plus soap treatment of Comparative example II-9, stable lubricity was exerted irrespective of treating methods, but loads to the environment are large in view of treatment of industrial wastes and waste water, control of treating liquids, high energy consumption by high temperature treatment, and so on. Thus, the lubricating coating forming agent of the invention, because of containing particles of a coated polyvalent metal salt of phosphoric acid and a water soluble inorganic salt, can prevent lowering of lubricity owing to ununiform coating which was the most difficult problem of coating-type lubricating coating forming agent, and can realize stable lubricity.

TABLE 4

Examples II-1 to II-12 and Comparative examples II-1 to II-9

| | | Ingredient *1 | | | | Ratio by mass as solid matter | | |
|---|---|---|---|---|---|---|---|---|
| | | (A) | (B) | (C) | (D) | (B)/(A) | (C)/(A) | (D)/(A) |
| Example (II) | 1 | zinc phosphate | sodium silicate*2 | montmorillonite | — | 10.0 | 0.01 | — |
| | 2 | zinc phosphate | potassium silicate*3 | hectorite | paraffin wax | 2.0 | 0.05 | 1.5 |
| | 3 | zinc phosphate | potassium tetraborate | — | polyethylene wax | 0.02 | — | 15.0 |
| | 4 | zinc iron phosphate | sodium silicate*2 | hectorite | sodium stearate | 0.5 | 0.25 | 0.5 |
| | 5 | zinc iron phosphate | sodium citrate | — | machine oil | 0.01 | 0.005 | 1.0 |
| | 6 | zinc iron phosphate | sodium sulfate | nontronite | — | 1.0 | 0.5 | — |
| | 7 | iron phosphate | sodium silicate + potassium sulfate*4 | — | palm oil | 16.0 | — | 2.0 |
| | 8 | iron phosphate | sodium tetraborate | hectorite | paraffin wax | 0.5 | 0.01 | 0.5 |
| | 9 | iron phosphate | potassium sulfate + potassium silicate*5 | sauconite | paraffin wax | 3.5 | 0.05 | 2.0 |
| | 10 | calcium phosphate | sodium silicate*2 | nontronite | — | 10.0 | 0.3 | — |
| | 11 | calcium phosphate | potassium sulfate + potassium silicate*4 | — | polyethylene wax | 15.0 | — | 0.05 |
| | 12 | calcium phosphate | sodium sulfate | hectorite | palm oil | 7.5 | 0.4 | 2.0 |
| Comparative example (II) | 1 | zinc phosphate | — | — | calcium stearate | — | 0.2 | 2.5 |
| | 2 | zinc iron phosphate | — | nontronite | polyethylene wax | — | 0.1 | 12.0 |
| | 3 | zinc phosphate*6 | sodium silicate*2 | nontronite | — | 0.1 | 0.05 | — |
| | 4 | calcium phosphate*6 | sodium tetraborate | — | palm oil | 5.0 | — | 5.0 |
| | 5 | iron phosphate | calcium hydroxide | — | paraffin wax | 2.0 | — | 2.5 |
| | 6 | zinc iron phosphate | iron oxalate | — | polyethylene wax | 1.0 | — | 0.5 |
| | 7 | — | potassium silicate*7 | — | graphite*8 | | *9 | |

| | | Proportion of ingredient as solid matter*10 | | |
|---|---|---|---|---|
| | | (B) | (D) | (E) |
| 8 | Existing coating-type lubricating film forming agent | 35% | 50% | 15% |

| | | Adhesion mass ($g/m^2$) | | |
|---|---|---|---|---|
| | | phosphate salt | metallic soap | unreacted soap |
| 9 | Phosphate salt treatment + soap treatment | 6.7 | 2.3 | 3.2 |

Notes of Table 4

*1 As to ingredients, (A) is a polyvalent metal salt of phosphoric acid, (B) is a water soluble inorganic salt or water soluble organic acid salt, (C) is a smectite clay mineral, and (D) is an auxiliary lubricant.

*2 $SiO_2:Na_2O = 2:1$

*3 $SiO_2:K_2O = 3:1$

*4 Sodium sulfate:sodium metasilicate = 7:3

*5 Sodium sulfate:potassium silicate ($SiO_2:K_2O = 3:1$) = 7:3

*6 Zinc phosphate and calcium phosphate whose surfaces are not coated with coating of metallic soap of these polyvalent metals were used.

*7 $SiO_2:K_2O = 4:1$

*8 In place of an auxiliary lubricant, graphite was used as a solid lubricant.

TABLE 4-continued

| Examples II-1 to II-12 and Comparative examples II-1 to II-9 | | | | | | | |
|---|---|---|---|---|---|---|---|
| | Ingredient *1 | | | | Ratio by mass as solid matter | | |
| | (A) | (B) | (C) | (D) | (B)/(A) | (C)/(A) | (D)/(A) |

*9 Comparative example 7 was carried out using potassium silicate ($SiO_2$:$K_2O$ = 4:1):graphite = 6:4.

*10In Comparative example 8, Ingredient B is sodium tetraborate, Ingredient D is calcium stearate, and Ingredient E is urethane resin (made by Dai-ichi Kogyo Seiyaku Co., Ltd.; Superflex 110).

*11Furthermore, as Ingredient (E), a phenol resin (made by Gunei Kagaku Co., Ltd.; Resitop PL-6020) was used in Example 9, and an urethane resin (made by Dai-ichi Kogyo Seiyaku Co., Ltd.; Superflex 110) in Example 12. The phenol resin and the urethane resin were used in amounts of 7.0% by mass and 8.5% by mass, respectively, based on the total of Ingredients (A) to (E), in terms of solid matter.

TABLE 5

| Results of evaluation (Examples II-1 to II-12 and Comparative examples II-1 to II-9 | | | | | | | | |
|---|---|---|---|---|---|---|---|---|
| | | Results of evaluation | | | | | | |
| | | Friction | Forging properties | | Tube reducing properties | | Wire drawing properties | | Load to |
| | | coefficient | one | barrel | one | bandled | one | bandled | environment |
| Example (II) | 1 | 0.07 | A | A | B | B | B | B | ○ |
| | 2 | 0.06 | A | A | A | A | A | A | ○ |
| | 3 | 0.05 | A | B | B | B | B | B | ○ |
| | 4 | 0.06 | A | A | A | A | A | A | ○ |
| | 5 | 0.05 | B | B | B | B | B | B | ○ |
| | 6 | 0.07 | B | B | B | B | B | B | ○ |
| | 7 | 0.07 | A | B | A | B | A | B | ○ |
| | 8 | 0.06 | A | A | A | A | A | A | ○ |
| | 9 | 0.06 | A | A | A | A | A | A | ○ |
| | 10 | 0.07 | B | B | B | B | B | B | ○ |
| | 11 | 0.06 | A | B | A | B | A | B | ○ |
| | 12 | 0.06 | A | A | A | A | A | A | ○ |
| Comparative examples (II) | 1 | 0.06 | C | D | C | D | B | D | ○ |
| | 2 | 0.05 | C | C | C | C | B | B | ○ |
| | 3 | 0.10 | D | D | D | D | D | D | ○ |
| | 4 | 0.08 | B | C | B | D | B | C | ○ |
| | 5 | 0.08 | B | D | B | D | B | C | ○ |
| | 6 | 0.06 | B | D | B | D | B | C | ○ |
| | 7 | 0.07 | C | D | C | D | C | C | ○ |
| | 8 | 0.07 | B | D | B | D | B | C | ○ |
| | 9 | 0.06 | B | B | A | A | A | A | X |

Lubricating coatings obtained by applying the lubricating coating forming agent of the invention onto the surfaces of various metallic materials give the metallic materials excellent cold plastic working properties, namely excellent lubricity and excellent seizure resistance. Particularly, the lubricating coating forming agent of the invention can give metallic materials excellent working performance even in barrel treatment and bundled treatment where it has been difficult for conventional coating-type lubricating coating forming agent to give stable working performance.

The invention claimed is:

1. A process for cold plastic working of metallic materials which comprises forming on the surface of a metallic material a lubricating coating containing, in an amount of 1% by mass or more, particles each of which particles consists of a water sparingly soluble or water insoluble polyvalent metal salt of phosphoric acid as a nucleus and a coating of a metallic soap of the polyvalent metal coating the surface of the nucleus, the polyvalent metal being at least one metal selected from Zn, Fe, Mn, Ni, Co, Mg, Ba, Al and Sn, the metallic soap being formed by reaction of the polyvalent metal salt of phosphoric acid with an alkali metal salt, ammonium salt or water soluble ester of a fatty acid, said particles being hereinafter called two-layer particles, or particles each of which consists of each of the two-layer particles and a coating of an alkali metal salt, ammonium salt or water soluble ester of a fatty acid coating the surface of the two-layer particle, said particles being hereinafter called three-layer particles, and subjecting the resulting metallic material to cold plastic working.

2. The process according to claim 1 wherein the particles are two-layer particles, the average particle size of the polyvalent metal salt of phosphoric acid is 300 μm or less and the proportion of all the metallic soap coatings to all the two-layer particles is 1 to 30% by mass.

3. The process according to claim 1 wherein the polyvalent metal salt of phosphoric acid is zinc phosphate.

4. The process according to claim 1 wherein the particles are three-layer particles, the average particle size of the polyvalent metal salt of phosphoric acid is 300 μm or less, the proportion of all the metallic soap coatings to all the two-layer particles is 1 to 30% by mass, and the proportion of all the coatings of the alkali metal salt, ammonium salt or water soluble ester of the fatty acid to all the three-layer particles is 0.1 to 5% by mass.

5. The process according to claim 1 wherein the formation of the lubricating coating is carried out by making powder consisting of the two-layer particles or the three-layer particles, or a mixture of the powder with at least one additive selected from the group consisting of waxes; solid lubricants, extremely pressure additives, coating forming resins, viscosity adjusting agents, lubricating oils, soaps and metallic soaps, then adhered to the surface of a metallic material.

6. The process according to claim 5 wherein, the additive is at least one additive selected from the group consisting of waxes, coating forming resins, soaps and metallic soaps, and after the powder or the mixture of the powder with the additive which is adhered onto the surface of the metallic material, the resulting metallic material is subjected to light plastic working of the order of skin pass, and then, subjecting the resulting metallic material to cold plastic working.

7. The process according to claim 1 wherein the formation of the lubricating coating is carried out by making a suspension wherein the two-layer particles are suspended in water or an aqueous solution of an alkali metal salt, ammonium salt or water soluble ester of a fatty acid, the average particle size of particles of the polyvalent metal salt of phosphoric acid being 20 μm or less, and the proportion of all the metallic soap coatings to all the two-layer particles being 1 to 30% by mass, adhering the coating onto the surface of the metallic material, and then, drying the resulting coating.

8. The process according to claim 7 wherein the suspension contains at least one additive selected from the group consisting of waxes, solid lubricants, extremely pressure additives, coating forming resins, viscosity adjusting agents, lubricating oils, soaps and metallic soaps.

9. The process according to claim 1 wherein dry coating thickness of the lubricating coating is 0.5 to 50 μm.

10. A process for cold plastic working of metallic materials which comprises applying onto the surface of a metallic material a lubricating coating forming agent wherein particles each of which consists of a water sparingly soluble or water insoluble polyvalent metal salt of phosphoric acid as a nucleus and a coating of a metallic soap of the polyvalent metal coating the surface of the nucleus, said particles being hereinafter referred to as particles of coated polyvalent metal salt of phosphoric acid, are suspended in an aqueous solution of a water soluble inorganic salt and/or a water soluble organic acid salt; the polyvalent metal being at least one selected from Zn, Fe, Mn, Ni, Co, Mg, Ba, Al and Sn, the metallic soap being formed by reaction of the polyvalent metal salt of phosphoric acid with an alkali metal salt, ammonium salt or water soluble ester of a fatty acid, and each of the water soluble inorganic salt and organic acid salt having a property to form a firm coating when it is uniformly dissolved in water and the resulting solution is applied onto a metallic material and dried;

drying the resulting wet coating to form a lubricating coating; and then, subjecting the resulting metallic material to cold plastic working.

11. The process according to claim 10 wherein the polyvalent metal salt of phosphoric acid is at least one selected from zinc phosphate, zinc iron phosphate and iron phosphate.

12. The process according to claim 10 wherein the average particle size of the particles of coated polyvalent metal salt of phosphoric acid is 30 μm or less, and the average particle size of the polyvalent metal salt of phosphoric acid is 20 μm or less.

13. The process according to claim 10 wherein the proportion of all the metallic soap coatings to all the particles of coated polyvalent metal salt of phosphoric acid is 1 to 30% by mass.

14. The process according to claim 10 wherein the water soluble inorganic salt is at least one selected from an alkali metal salt of sulfuric acid, an alkali metal salt of silicic acid and an alkali metal salt of boric acid.

15. The process according to claim 10 wherein the water soluble organic acid salt is at least one selected from an alkali metal salt of malic acid, an alkali metal salt of succinic acid, an alkali metal salt of citric acid and an alkali metal salt of tartaric acid.

16. The process according to claim 10 wherein the proportion by mass of the total of the water soluble inorganic salt and the water soluble organic acid salt (B) to the particles of coated polyvalent metal salt of phosphoric acid (A), namely (B)/(A), in terms of solid matter, is within the range of 0.01 to 20.0.

17. The process according to claim 10 wherein the lubricating coating forming agent contains a smectite clay mineral in such an amount that the proportion by mass of the smectite clay mineral (C) to the particles of coated polyvalent metal salt of phosphoric acid (A), namely (C)/(A), in terms of solid matter, is within the range of 0.005 to 0.5.

18. The process according to claim 10 wherein the lubricating coating forming agent contains, as an auxiliary lubricating ingredient, at least one auxiliary lubricating ingredient (D) selected from an oil, a soap, a metallic soap, a wax and polytetrafluoroethylene in such an amount that the proportion by mass of the auxiliary lubricating ingredient (D) to the particles of coated polyvalent metal salt of phosphoric acid (A), namely (D)/(A), in terms of solid matter, is within the range of 0.03 to 18.0.

19. The process according to claim 10 wherein the lubricating coating forming agent contains a water soluble or water dispersible organic macromolecular compound having a weight average molecular weight of 1,000 to 1,000,000 in such an amount that its content in the resulting coating gets to be within 0.5 to 25% by mass based on the whole dry coating.

* * * * *